US005839685A

United States Patent [19]

Chen

[11] Patent Number: 5,839,685

[45] Date of Patent: Nov. 24, 1998

[54] ANTI-STATIC THREAD FEEDING WHEEL FOR KNITTING MACHINERY

[76] Inventor: Jen Hui Chen, 4FL. 27, Lane 160, Hsin Sheng S. Rd., Sec. 1, Taipei, Taiwan

[21] Appl. No.: 960,107

[22] Filed: Oct. 27, 1997

Related U.S. Application Data

[63] Continuation of Ser. No. 670,114, Jun. 25, 1996, abandoned, which is a continuation-in-part of Ser. No. 507,677, Jul. 25, 1995, abandoned.

[51] Int. Cl.[6] ..... B65H 71/00; B65H 51/30; D04B 15/48

[52] U.S. Cl. ..... 242/366; 66/132.1; 242/906

[58] Field of Search ..... 242/47.01, 615.4, 242/900, 906, 366; 66/132 T, 132 R

[56] References Cited

U.S. PATENT DOCUMENTS

| | | | |
|---|---|---|---|
| 3,957,217 | 5/1976 | Clemens | 66/132 R X |
| 4,004,438 | 1/1977 | Raisin | 66/132 T |
| 4,137,731 | 2/1979 | Jacobsson | 242/47.01 X |
| 4,574,597 | 3/1986 | Buck et al. | 242/47.01 X |
| 4,662,575 | 5/1987 | Fecker | 242/47.01 |
| 4,754,936 | 7/1988 | Dalmau Guell et al. | 66/132 R X |
| 4,861,440 | 8/1989 | Covino | 204/38.3 |
| 4,890,464 | 1/1990 | Tsuchiya et al. | 66/132 T |
| 5,105,513 | 4/1992 | Marx et al. | 28/263 |
| 5,415,106 | 5/1995 | Groskreutz et al. | 104/173.2 |
| 5,419,970 | 5/1995 | Hattori et al. | 428/565 |

*Primary Examiner*—Michael Mansen
*Attorney, Agent, or Firm*—Bacon & Thomas

[57] ABSTRACT

The thread feeding wheel is capable of preventing static-electricity from being produced due to rapid feeding of the thread and which provides a surface having a low frictional coefficient so that the thread feeding around the thread feeding wheel would subject to minimal frictional damage. The cylindrical body is made of an aluminum alloy. A layer of oxide of the aluminum alloy is formed by a hard anodizing process on the middle portion of said cylindrical body. A layer of polytetrafluoroethylene resin is impregnated over said oxide layer to further reduce the frictional coefficient of the thread running surface.

1 Claim, 3 Drawing Sheets

ANTI-STATIC THREAD FEEDING WHEEL FOR KNITTING MACHINERY

This application is a continuation of application Ser. No. 08/670,114, filed Jun. 25, 1996, now abandoned, which is a continuation-in-part (CIP) of U.S. patent application Ser. No. 08/507,677 filed on Jul. 25, 1995, which is now abandoned.

BACKGROUND OF THE INVENTION

1. Field of the Invention

The present invention relates to knitting machinery, and more particularly, to an anti-static thread feeding wheel for use in knitting machinery which can prevent static-electricity from being produced due to rapid feeding of the thread.

2. Description of Related Art

In early days, thread used to weave the fabric is made of coarse fibrous material that allows the weaving machines to operate at low speeds of 20 to 25 rpm. In the past few years, new technologies allow the production of fine artificial fibers that can be used to weave high-quality fabrics. In a single thread, the number of fibers stranded therein is increased from 36 to 96 and as high as 144. To deliver such a thread, the weaving machine is operated at higher speeds of 30 to 40 rpm, which means the thread feeding wheel is rotated at a speed of 900 to 1,200 rpm.

Since the thread feeding wheel is typically made of metal such as aluminum, a thread running at high speed therethrough would cause static-electricity to be produced. The thus produced static-electricity will be affixed to and carried by the thread to the woven fabric, thus causing fissures to appear on the woven fabric due to mutual repelling of neighboring threads. The appearance of such fissures would significantly deteriorate the texture quality of the woven fabric. The static-electricity could further attract fluffs of the threads and make them to be included in the woven fabric, which would further deteriorate the texture quality of the woven fabric.

A number of conventional ways are proposed to prevent the static-electricity from being produced. One way is to use a drum-type thread feeding wheel which allows a minimal area of contact with the thread. But since metal bars are used as the contacting surface, static-electricity still can be produced if the high-speed running thread is in touch with these metal bars. One solution to this problem is to replace the metal bars with friction-resistant ceramic bars. However, since the ceramic bars are too weighty for easy handling by the mechanism of the knitting machine, this solution is still not satisfactory. Another solution is to use plastic for making the thread feeding surface of the thread feeding wheel. However, since plastic surface has a high frictional coefficient which would heat to generate when a thread is running at high speed therethrough, the thread feeding wheel could be easily get deformed.

SUMMARY OF THE INVENTION

It is therefore a primary objective of the present invention to provide a thread feeding wheel for use in text machinery which can prevent static-electricity from being produced due to rapid feeding of the thread.

It is another objective of the present invention to provide a thread feeding wheel whose surface has a low frictional coefficient so that the thread winding around the thread feeding wheel would subject to minimal frictional damage.

It is still another objective of the present invention to provide a thread feeding wheel which is made of rigid material so that the frictional heat produced due to rapid feeding of the thread would not cause the thread feeding wheel to be deformed.

In accordance with the foregoing and other objectives of the present invention, a novel thread feeding wheel for use in text machinery is provided. The thread feeding wheel comprises a cylindrical body having a middle portion and two projecting rims. The cylindrical body is made of an aluminum alloy selected from the 6000 Al—Mg—Si series or the 7000 Al—Zn series according to the American Aluminum Association standard. A layer of oxide of the aluminum alloy is formed by a hard anodizing process on the middle portion of said cylindrical body. The thus formed oxide layer has a thickness of 20 to 80 $\mu$m, a breakdown voltage up to 1,500 V DC, an electrical resistance of about in the range from $2\times10^{15}$ to $5\times10^{15}$ $\Omega/cm^2$ at 20° C., a melting point of up to 2,050° C., and a hardness of about in the range from RC30 to RC60 according to the Rockwell Hardness Scale. Besides, a diffusion layer is formed beneath said oxide layer with a hardness of about RC60, which further strengthens the thread feeding wheel. A layer of polytetrafluoroethylene resin is impregnated over said oxide layer to further reduce the frictional coefficient of the thread running surface.

BRIEF DESCRIPTION OF DRAWINGS

The present invention can be more fully understood by reading the subsequent detailed description of the preferred embodiments thereof with references made to the accompanying drawings, wherein.

DETAILED DESCRIPTION OF PREFERRED EMBODIMENT

Figure 1:
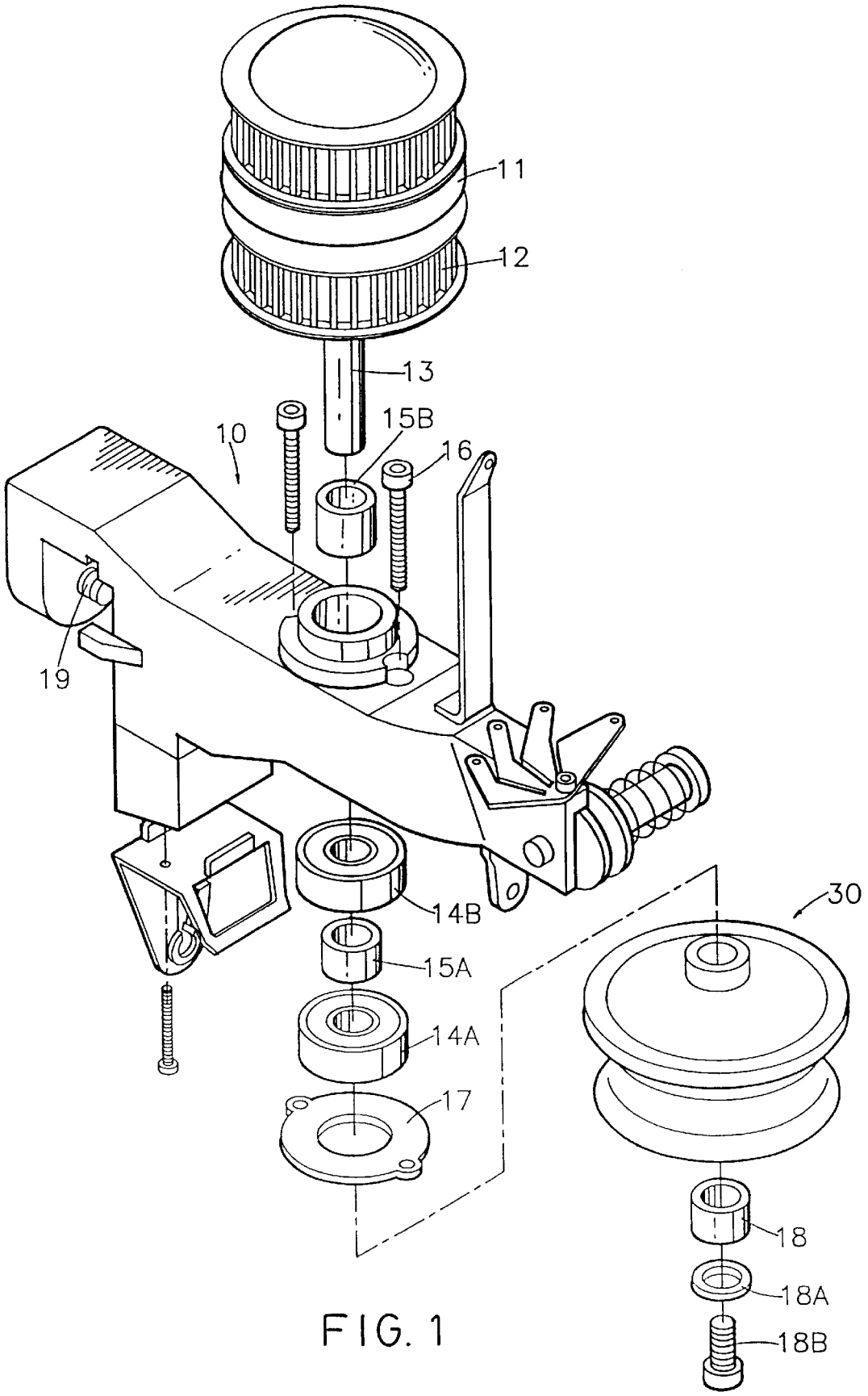
FIG. 1 shows an exploded perspective view of a thread feeding device employing a thread feeding wheel according to the present invention.
Figure 2:
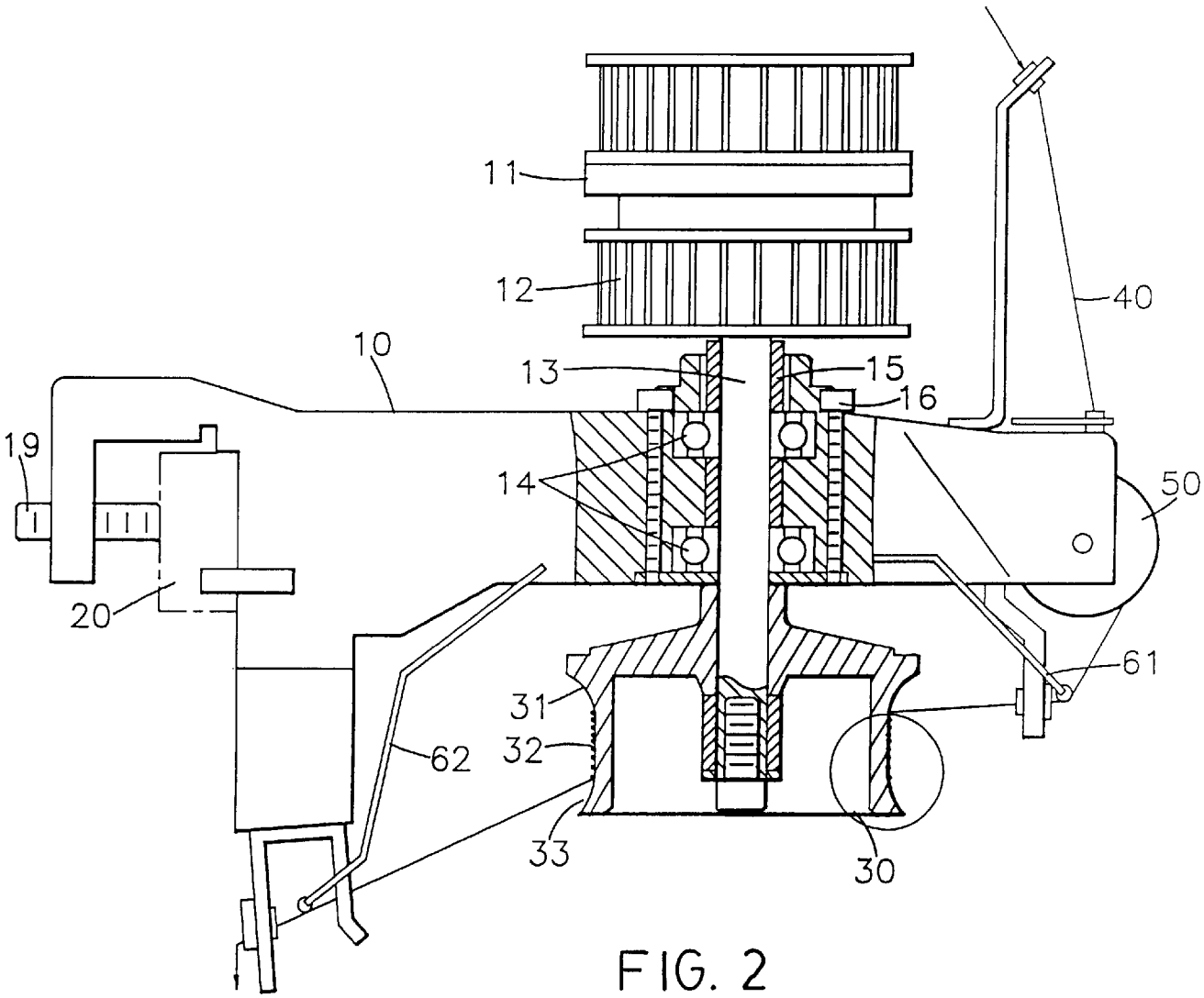
FIG. 2 shows a side cross-sectional view of the thread feeding device of FIG. 1.

Referring to FIGS. 1 and 2, there is shown a thread feeding device which employs a thread feeding wheel 30 according to the present invention. Beside the thread feeding wheel 30, the thread feeding device includes a mounting base 10 for mounting the thread feeding wheel 30, a pulley 12 driven by a belt (not shown) for rotation, and engagement/disengagement means 11 for coupling the power transmission from the belt (not shown) to the pulley 12. A shaft 13 is coupled between the pulley 12 and the thread feeding wheel 30 so as to transmit the rotation of the pulley 12 to the thread feeding wheel 30. The mounting base 10 includes a bottom bearing 14A, a bottom sleeve 15A, a top bearing 14B, a top sleeve 15B, a circular metal piece 17, and two screws 16, which are in combination used to mount the thread feeding wheel 30, the shaft 13, and the pulley 12 in position.

As shown in FIG. 2, the thread feeding wheel 30 according to the present invention is a cylindrical body made of light metal such as aluminum alloy and having two projecting rims 31, 33 and a middle portion 32. Preferably, the aluminum alloy is an alloy of aluminum-magnesium-silicon (Al—Mg—Si) selected from the 6000 Al—Mg—Si series (6061, 6063) according to the American Aluminum Association (AA) standard. The 7000 Al—Zn series is also usable but less preferable since the aluminum alloys of this series are much more costly to use.

The diameter of the lower end of the middle portion 32 is about 0.5 mm less than the upper end of the middle portion. The thread feeding wheel 30 is used as an intermediate storage means for the delivery of a thread 40 from the spool (not shown) to a weaving station where a needle (not shown) is used to weave the fabric. The thread 40 is guided into the thread feeding wheel 30 via the top projecting rim 31, wound around the middle portion 32, and then pulled away from the thread feeding wheel 30 via the bottom projecting rim 33.

Figure 3B:
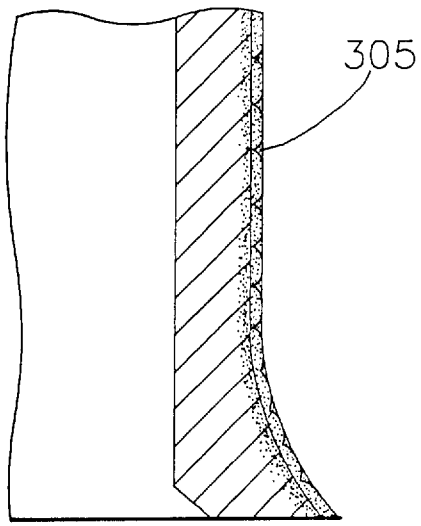
FIG. 3B shows a sectional view of the surface structure of a second preferred embodiment of the thread feeding wheel according to the present invention.
Figure 3A:
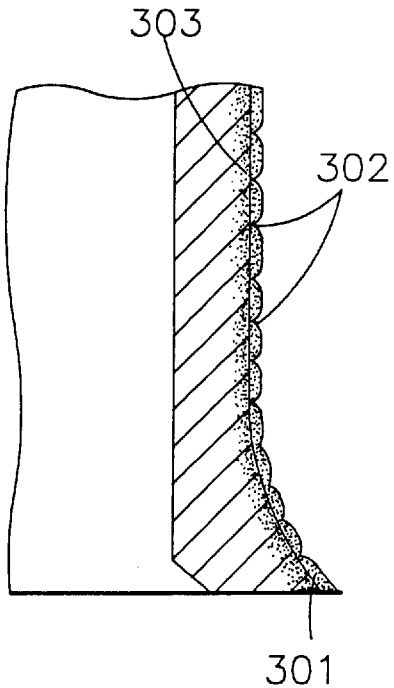
FIG. 3A shows a sectional view of the surface structure of a first preferred embodiment of the thread feeding wheel according to the present invention.

Referring also to FIGS. 3A—3B, the outer surface of the middle portion 32 of the thread feeding wheel 30 is hard anodized to form a layer of an oxide of the aluminum alloy 301 (this process is also referred to as "hardcoating"). Preferably, the oxide layer 301 is formed to a thickness of 20 to 80 $\mu$m which is a suitable thickness for the thread running surface of the thread feeding wheel 30 to withstand the high-speed running thread. As mentioned earlier, the aluminum alloy is preferably the 6000 Al—Mg—Si series (6061, 6063) aluminum alloy or the less preferable but usable 7000 Al—Zn series. These two types of aluminum alloys would allow the oxide layer 301 to be formed with a breakdown voltage up to 1,500 V DC, an electrical resistance of about $2\times10^{15}$ to $5\times10^{15}$ $\Omega/cm^2$ (normally $4\times10^{15}$ $\Omega/cm^2$) at 20° C., a melting point of up to 2,050° C., and a hardness of about in the range from RC30 to RC60 according to the Rockwell Hardness Scale. These values may vary slightly depending upon the exact conditions under which the hardcoating is performed. The high electrical resistance prevents the generation of static-electricity when the high-speed thread is running through the thread feeding wheel 30, the high melting point prevent the oxide layer 301 of the thread feeding wheel 30 from being scratched due to heat generated from the friction between the running thread and the thread winding surface of the thread feeding wheel 30, and the high hardness prevents the thread feeding wheel 30 from being scratched due to stress applied by the running thread.

Besides, the hardcoating of the oxide layer 301 also allows the forming of a diffusion layer 303 beneath the oxide layer 301 to a depth about equal to the thickness of the oxide layer 301. The diffusion layer is formed by penetration of some of the aluminum oxide molecules into the aluminum alloy. The diffusion layer 303 thus formed has a hardness of up to about RC60 according to the Rockwell Hardness Scale. As a result, the forming of the diffusion 303 further strengthens the thread winding wheel 20.

As shown in FIG. 3A, the hardcoating of the oxide layer 301 on the outer surface of the thread feeding wheel 30 would provide a rugged surface having a plurality of crevices 302 thereon. The presence of these crevices 302 would cause a frictional coefficient of about 0.2 to the oxide layer 301. So as to polish the oxide layer 301 for a less frictional coefficient, a layer of supermicro grained (granularity less than 5 $\mu\mu$m) polytetrafluoroethylene (PTFE) resin 305 which is supplied by the Du Pont Corporation under the trademark TEFLON is impregnated over the oxide layer 301 as shown in FIG. 3B. The PTFE resin layer 305 would substantially fill up the crevices 302 and provide a polished effect to the oxide layer 301, thus allowing the frictional coefficient of the outer surface of the middle portion 32 of the thread feeding wheel 30 to be reduced to as low as about 0.08. The PTFE resin is also an insulating material which would hardly cause static-electricity when a high-speed thread is running therethrough. Also, with such a low frictional coefficient of about 0.08, the running of the thread 40 through the middle portion 32 of the thread feeding wheel 30 would allow virtually no static-electricity to be produced.

The present invention has been described hitherto with exemplary preferred embodiments. However, it is to be understood that the scope of the present invention need not be limited to the disclosed preferred embodiments. On the contrary, it is intended to cover various modifications and similar arrangements within the scope defined in the following appended claims. The scope of the claims should be accorded the broadest interpretation so as to encompass all such modifications and similar arrangements.

What is claimed is:

1. An improved thread feeding wheel assembly for use on a knitting machine including a body having a substantially cylindrical middle portion with projecting rims projecting from opposite ends of the substantially cylindrical middle portion, said cylindrical body made from an aluminum alloy;

a mounting base for mounting the body, a pulley driven by a belt for rotation, an engagement/disengagement means for coupling power transmission from the belt to the pulley, a shaft coupled between the pulley and the body to transmit the pulley rotation to the body;

the mounting base including a bottom bearing, a bottom sleeve, a top bearing, a top sleeve, and a circular metal piece which in combination are used to mount the body, the shaft, and the pulley in common;

the improvement comprising:

a layer of aluminum oxide formed on said middle portion of said body, said layer having a thickness of 50 $\mu$m, an electrical resistance of $2\times10^{15}$ to $5\times10^{15}$ $\Omega/cm^2$ at 20° C., and a hardness of RC30–RC60 according to the Rockwell Hardness Scale, the aluminum oxide layer having an outer surface; and, a layer of polytetrafluoroethylene on the outer surface of the aluminum oxide layer, the layer of polytetrafluoroethylene having an outer surface with a frictional coefficient of approximately 0.08, whereby the thickness, hardness and electrical resistance of the layer of aluminum oxide have the effect of preventing generation of static-electricity when high-speed thread is running through the thread feeding wheel.

* * * * *